United States Patent [19]

Armand

[11] Patent Number: 4,770,750

[45] Date of Patent: Sep. 13, 1988

[54] PROCESS FOR PRODUCING TRANSITION METAL POWDERS BY ELECTROLYSIS IN MELTED SALT BATHS

[75] Inventor: Marcel Armand, Meylan, France

[73] Assignee: Pechiney, Lyons, France

[21] Appl. No.: 99,317

[22] PCT Filed: Jan. 5, 1987

[86] PCT No.: PCT/FR87/00001

§ 371 Date: Aug. 20, 1987

§ 102(e) Date: Aug. 20, 1987

[87] PCT Pub. No.: WO87/04192

PCT Pub. Date: Jul. 16, 1987

[30] Foreign Application Priority Data

Jan. 6, 1986 [FR] France ..... 86 00390

[51] Int. Cl.[4] ..... C25D 1/00; C25D 3/26

[52] U.S. Cl. ..... 204/10; 204/64 T

[58] Field of Search ..... 204/10, 64 T

[56] References Cited

U.S. PATENT DOCUMENTS 2,951,021 8/1960 Di Pietro ..... 204/64 T

FOREIGN PATENT DOCUMENTS 1265427 5/1961 France ..... 204/64 T 736567 9/1955 United Kingdom ..... 204/64 T

*Primary Examiner*—T. M. Tufariello

*Attorney, Agent, or Firm*—Dennison, Meserole, Pollack & Scheiner

[57] ABSTRACT

The invention relates to a process for producing transition metal powders by electrolysis in melted salt baths. This process is characterized in that electrolysis is performed in such a way that the deposition voltage of the transition metal is 0.1 to 0.4V below that of the alkali metal or alkaline earth metal which it is the easiest to reduce.

It is used in the production of powders having dimensions between a few fractions of a micron and approximately 200 microns from metals belonging to groups IVb, Vb and VIb of the periodic classification of metals, such as e.g. titanium, zirconium and hafnium.

6 Claims, No Drawings

PROCESS FOR PRODUCING TRANSITION METAL POWDERS BY ELECTROLYSIS IN MELTED SALT BATHS

The present invention relates to the production of transition metal powders by the electrolysis of their halides in melted salt baths.

1. Transition metals refer to any metal belonging to columns IVb, Vb, VIb of the periodic classification of elements.

2. Powder is understood to mean a finely divided solid substance having grains with a size between a few fractions of a micron and approximately 200 microns.

In connection with expensive metals, such as transition metals, there is a considerable interest in applying powder metallurgy shaping methods, due to the considerable material economies resulting therefrom. The main difficulty encountered in this connection is the producing of powders with a suitable quality.

Reference is made to the following among the presently used processes:

from solid metals:

1. the process involving hydrogenation, grinding and dehydrogenation, 2. processes involving electron beam or arc melting and centrifugal atomization;

from an oxide or a salt:

the process involving reduction by hydrogen at a very high temperature.

Generally, these processes require large, complex and costly installations. In addition, they do not always lead to suitable powders, either from the purity standpoint, or from the standpoint of grain size or grain shape.

The process according to the present invention comprises electrolysis of a halide of the metal, particularly its chloride, dissolved in a bath of melted salts based on alkali metal or alkaline earth halides, performed under special conditions. Electrolytic processes, which are known for these metals, lead to deposits of excellent quality from the purity standpoint and which are in the form of more or less solid or dendritic crystals, which can be directly used for melting purposes, but which are unsuitable for powder metallurgy.

It has been proposed to obtain more highly divided forms by greatly increasing the current densities on the deposition cathodes, but under these conditions there is a very poor or even non-existent adhesion of the metal to the cathodes. The products obtained become detached and are dispersed in the bath, where they are prejudicial to the electrolysis operation and are difficult to recover.

The Applicant found that it was possible to obviate this disadvantage using conventional current densities (0.3 to 1.0 A/cm$^2$) and obtain sufficiently adhesive pulverulent deposits to permit extraction with cathodes.

The process is characterized in that electrolysis is obtained in such a way that the deposition voltage of the metal to be obtained in powder form is 0.1 to 4.0 V and preferably 0.2 to 0.3 V below that of the alkali metal or alkaline earth metal which is the easiest to reduce.

It is known that the deposition potential E of a metal from the solution of one of its salts is given by the NERNST law:

$$E = E_o + \frac{RT}{nF} \text{Log} a$$

in which $E_0$ is the normal potential, R the constant of perfect gases, T the temperature in degrees K., n the number of electrons exchanged, F the FARADAY number and a the activity of the ions of the metal in the solution.

Thus, there are clearly two ways of modifying E, either by acting on a, i.e. on the concentration, or by acting on $E_0$ by modifying the complexing state of the ions.

The research carried out for realizing the invention was carried out in a cell comprising a metal tank containing the molten bath and a metal cover ensuring the sealing of the system and having a number of openings, inter alia for the tight, insulated passage of the anode and cathode devices immersed in the bath, the supply of the bath with the halide of the metal to be produced and the extraction of the halogen formed through the anode.

The following examples illustrate the application of the process according to the two embodiments described hereinbefore.

EXAMPLE 1

This example relates to titanium. In this case, the anode device also has a diaphragm subdividing the bath into two compartments, namely an anode compartment only containing traces of titanium in solution and a cathode department in which the dissolved titanium content is kept constant as a result of a continuous supply means.

The bath is constituted by an equimolecular mixture of potassium and sodium chlorides melted at 750° C. Titanium tetrachloride is the halide introduced. Under conventional electrolysis conditions, the titanium content dissolved in the bath is 4%.

With an initial cathode current density of 1.0 A/cm$^2$ the titanium deposition voltage measured by plotting the voltage/current curve is 2.15 V and that of the alkali which is the most difficult to reduce, i.e. in the present case sodium is 3.2 V.

The deposits collected on the cathode are in the form of well crystallized dendrites which can reach several centimeters and comply with the following analysis in ppm:

| O | Al | Fe | Cu | Mn | Si | Sn | V | Y | Mo remainder Ti |
|---|---|---|---|---|---|---|---|---|---|
| 380 | <50 | 77 | <20 | <50 | <100 | <100 | <50 | <50 | 10 |

The electrical efficiency exceeds 90%.

On reducing the titanium content in the cathode compartment to 0.1%, under the same current density conditions, the titanium deposition voltage becomes 2.9 V and that of the alkali remains equal to 3.2 V. On the cathode is collected a type of grey felt constituted by intermixed fine dendrites, which after washing with water give a powder which almost entirely passes through the 100 micron mesh size screen and which complies with the following analysis in ppm:

| O | Al | Fe | Cu | Mn | Si | Sn | V | Y | Mo remainder Ti |
|---|---|---|---|---|---|---|---|---|---|
| 700 | <50 | 130 | <20 | 95 | <100 | <100 | <50 | <50 | <10 |

The electrical efficiency exceeds 85%.

EXAMPLE 2

This example related to hafnium.

Using the same cell as in example 1, but without an anode diaphragm, but still with the equimolecular NaCl/KCl bath, the halide introduced being on this occasion hafnium tetrachloride in a quantity of 25% and under normal electrolysis conditions, i.e. with a current density of 1.0 A/cm$^2$, the hafnium deposition voltage is 2.2 V and deposits are obtained in the form of relatively solid dendrites (cauliflower appearance) with an electrical efficiency exceeding 95%. The analysis of these deposits gives the following results in ppm:

| C | N | O | Al | B | Cr | Cu | Fe | Mn | Si | Ti | V | W remainder Hf |
|---|---|---|---|---|---|---|---|---|---|---|---|---|
| <10 | <10 | 250 | 39 | 2.4 | 27 | <10 | <20 | 36 | <25 | <10 | <10 | <15 |

If F-ions are introduced into the bath by adding e.g. sodium fluoride in such a way that the fluorine:hafnium molecular ratio is equal to 12, under the same electrolysis conditions the hafnium deposition voltage passes to 2.9 V and, after washing the deposit, a powder is obtained which substantially entirely passes through the 200 micron mesh size screen and complies with the following analysis in ppm:

| C | N | O | Al | B | Cr | Cu | Fe | Mn | Si | Ti | V | W remainder Hf |
|---|---|---|---|---|---|---|---|---|---|---|---|---|
| 12 | <10 | 290 | 68 | 2.7 | 20 | 11 | <20 | 16 | <25 | <10 | <10 | <10 |

It should be noted that on this occasion the fluorine:hafnium ratio is equal to 12, but that with other metals values of this ratio between 3 and 20 can be used. The best results are obtained in the range of values between 6 and 12.

I claim:

1. A process for producing a transition metal powder having a particle size substantially in a range of less than about 200 microns by electrolysis of a corresponding transition metal halide dissolved in a molten salt bath comprising one or more alkali metal and/or alkaline earth metal halides, comprising adjusting the concentration of said transition metal such that the deposition voltage of said transition metal is 0.1 to 0.4 volts less than that of the salt bath metal having the lowest deposition potential.

2. A process for producing a transition metal powder having a particle size substantially in a range of less than about 200 microns by electrolysis of a corresponding transition metal halide dissolved in a molten salt bath comprising one or more alkali metal and/or alkaline earth metal halides, comprising adjusting the complexing state of said metal by carrying out said electrolysis in the presence of the fluoride ion, with the molecular ratio of fluorine to said transition metal present in said salt bath being 6:1 to 12:1.

3. Process according to claim 1 or 2, wherein the deposition voltage is lower by 0.2 to 0.3 V.

4. Process according to claim 1 or 2 wherein the salt bath used is an equimolecular NaCl/KCl mixture melted at 750° C. and that the halide of the metal to be deposited is a chloride.

5. Process according to claim 1 or 2, wherein said transition metal is titanium, zirconium or hafnium.

6. Process according to claim 2, wherein said fluoride ion is introduced in the form of NaF.

* * * * *